United States Patent [19]

Watanabe et al.

[11] Patent Number: 4,966,480

[45] Date of Patent: Oct. 30, 1990

[54] WASHING LIQUID CARTRIDGE FOR REFILL INK TYPE WRITING INSTRUMENT

[75] Inventors: Hitosi Watanabe, Ageo; Ikuo Takagishi; Toshinobu Kosaka, both of Soka; Katsuhiko Kawabata, Kasukabe, all of Japan

[73] Assignee: Pentel Kabushiki Kaisha, Tokyo, Japan

[21] Appl. No.: 240,351

[22] Filed: Sep. 1, 1988

Related U.S. Application Data

[63] Continuation-in-part of Ser. No. 17,073, Feb. 20, 1987, abandoned.

[30] Foreign Application Priority Data

Feb. 28, 1986 [JP] Japan ..... 61-28330[U]

[51] Int. Cl.[5] ..... B43K 13/00

[52] U.S. Cl. ..... 401/134; 401/132; 401/221; 401/258; 401/292

[58] Field of Search ..... 15/423, 104.92; 401/197, 132, 133, 134, 135, 221, 292, 258

[56] References Cited

U.S. PATENT DOCUMENTS

| | | | |
|---|---|---|---|
| 682,575 | 9/1901 | Skilton | 134/169 R |
| 768,637 | 8/1904 | Thowless | 134/169 R |
| 1,666,186 | 4/1928 | Tong | 134/169 R |
| 3,138,142 | 6/1964 | Levy | 401/134 |
| 3,393,962 | 7/1968 | Andrews | 401/132 |
| 3,539,268 | 11/1970 | Stebbins | 401/197 |

FOREIGN PATENT DOCUMENTS

| | | | |
|---|---|---|---|
| 3146242 | 5/1983 | Fed. Rep. of Germany | 400/702 |
| 1390187 | 4/1975 | United Kingdom | 401/132 |

*Primary Examiner*—Steven A. Bratlie

*Attorney, Agent, or Firm*—Wenderoth, Lind & Ponack

[57] ABSTRACT

A washing liquid cartridge removably positionable in a writing instrument of the type having a removable ink container. The washing liquid container contains therein a washing liquid and has an engagement portion at one end removably engagable with an inner element of the writing instrument and an openable seal adjacent to the engagement portion. When the seal of the cartridge is opened and the cartridge is snugly fitted in position within the writing instrument in place of the ink container, the washing liquid in the cartridge flows and washes the ink passage within the writing instrument.

5 Claims, 1 Drawing Sheet

WASHING LIQUID CARTRIDGE FOR REFILL INK TYPE WRITING INSTRUMENT

This application is a continuation-in-part, of now abandoned application Ser. No. 07/017,073 filed Feb. 20, 1987 now abandoned.

BACKGROUND OF THE INVENTION

The present invention relates in general to a writing instrument of the type employing a removable, refill ink container which is made and sold separately from the writing instrument and, more particularly, the present invention provides a novel washing liquid cartridge which contains a washing liquid and is adaptable to the above-described refill ink type writing instrument for washing an ink passage within the writing instrument.

Various types of ink for a writing instrument have been used and the ink can be classified into two types: one having a resin as a component and the other having no resin contained therein. The former type of ink contains a pigment and is used in, for example, a writing instrument of the type having a tubular writing tip and a needle longitudinally movably mounted within the tubular writing tip. This type of writing instrument preferably has a weight or an inertia member connected to the movable needle so as to enhance the longitudinal movement of the needle for the principal purpose of ensuring a continuous and reliable capillary action of ink from the removable ink container or ink refill towards the tubular writing tip. The latter type of ink containing no resin contains a dye and is used in a generally known fountain pen.

The ink containing a resin has many advantages but has a problem that it tends to create difficulties in successive uses of a writing instrument when the ink in the instrument is locally or entirely dried and solidified because the resin used for this type of ink is water-insoluble or difficult to dissolve in water and, thus, the instrument can not be effectively washed with water.

Therefore, a washing liquid has been made commercially available separately for an non-disposable or permanent-type writing instrument using an ink container and a resin-containing ink so as to cope with the problem of drying of the ink. When the commercially available washing liquid is used for washing the writing instrument, as shown in FIGS. 3A–3F, a cap of a washing liquid tank 2 is removed (FIG. 3A) and washing liquid 1 is poured into a cup 3 or any other suitable utensil (FIG. 3B). Thereafter, a part or parts 4 of the writing instrument to be washed is dipped into the washing liquid (FIG. 3C). When the dried and solidified ink is dissolved fully, the washing liquid 1 is discharged from the cup 3 (FIG. 3D) and then the parts 4 of the writing instrument are washed with water (FIG. 3E) and dried for a successive use (FIG. 3F). If an immediate use of the writing instrument is desired, an ultrasonic treatment can be applied when the parts 4 are dipped into the washing liquid 1 and drying is carried out by a suitable drying apparatus.

A problem with the washing procedure described above is that not only the inside of the writing instrument but also the outside thereof is extensively soiled more than is necessary by the washing liquid containing dissolved resin.

SUMMARY OF THE INVENTION

An object of the present invention is to provide a washing liquid cartridge which can be removably positioned in a writing instrument of the type having a removable ink container.

Another object of the present invention is to provide a washing liquid cartridge which can be easily adapted to the writing instrument.

Another object of the present invention is to provide a washing liquid cartridge which permits effective cleaning of ink passage within the writing instrument without causing the writing instrument to be extensively and unnecessarily soiled.

A further object of the present invention is to provide a washing liquid cartridge which permits a flow of the washing liquid into the ink passage in the writing instrument.

According to the present invention, there is provided a washing liquid cartridge for a writing instrument of the type having a removable ink container and an ink passage connected to a writing tip at one end and the ink container at the other end. The ink container contains an ink having a resin as a component thereof. The washing liquid cartridge which contains therein a washing liquid for dissolving the resin in the ink has an openable seal at its one end. Thus, when the seal of the cartridge is opened and the cartridge is snugly fitted in position within the writing instrument, the washing liquid in the cartridge flows through the ink passage within the writing instrument. The washing liquid cartridge is adapted to be placed in position similar to the conventional removable ink container.

It will depend upon the inner, structure of a writing instrument how and where dried ink is located, but the washing liquid discharged from the washing liquid container will flow along the passage for the ink and dissolve the dried ink retained in the passage.

PREFERRED EMBODIMENT OF THE INVENTION

Figure 1:
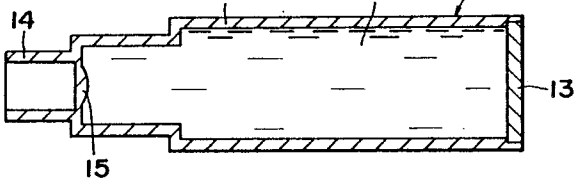
FIG. 1 is a longitudinally sectional view of a washing liquid cartridge embodying the present invention.

Referring first to FIG. 1, a bottle-shaped washing liquid cartridge 10 which contains therein a suitable washing liquid 11, which will be described presently, has a cartridge body with longitudinal tubular casing 12 having a bottom 13 and the cartridge body has a tubular engagement portion 14 projecting in a direction away from the bottom. The to form a bottle shaped cartridge. The cartridge 10 has an openable seal 15 at the inner end portion of the engagement portion 14. The cartridge 10 is preferably made of a transparent synthetic resin, for example a polyolefin such as polyethylene and polypropylene, polycarbonate and the like, which are generally used as a material for a conventional removable ink container, so that the washing liquid itself and washing procedure can be visually inspected through the transparent cartridge 10 since the washing liquid 11 in the cartridge will be soiled as the washing proceeds, and the washing liquid can be forcibly directed into the ink passage of the writing instrument the cartridge is manipulated by the user to exert a pressure on the cartridge by squeezing it. The washing liquid cartridge 10 preferably has a shape and size substantially identical to the ink container which is usually used in the writing instrument although any shape which will fit into the space where the ink cartridge is normally held in the writing instrument. In practice, an amount the washing liquid which is about one fourth of the total amount of the ink in an ink container may be satisfactory.

The manipulation of the cartridge by the user to exert a pressure on the cartridge is not essential in the present invention. It is also possible to clean the ink passage by simply inserting the cartridge into the writing instrument and allowing the writing instrument to stand for several hours. Namely, in the case where the ink within the ink passage becomes too sticky to flow to the writing tip and the ink passage is filled with such sticky ink, when the cartridge is simply inserted and the write instrument allowed to stand, the washing liquid flows toward the writing tip and is mingled with the ink and dilutes the ink. As a result, the sticky ink within the ink passage is dissolved in the washing liquid and its viscosity is decreased. Also in the case where the ink is dried and solidified at a certain position within the ink passage and the passage is otherwise free of ink, the washing liquid flows through the empty passage by capillary action toward the writing tip until it contacts the solidified ink. By such contact with the washing liquid, the solidified ink is dissolved in the washing liquid.

When the dissolution of the sticky or solidified ink proceeds, the concentration of dissolved ink becomes higher at the contact portion, and reaches saturation. However, the washing liquid fraction containing a high proportion of dissolved ink is mingled with the adjacent washing liquid fraction containing lower proportion of dissolved ink, so that the concentration of dissolved ink becomes lower throughout the overall amount of washing liquid.

Figure 2:
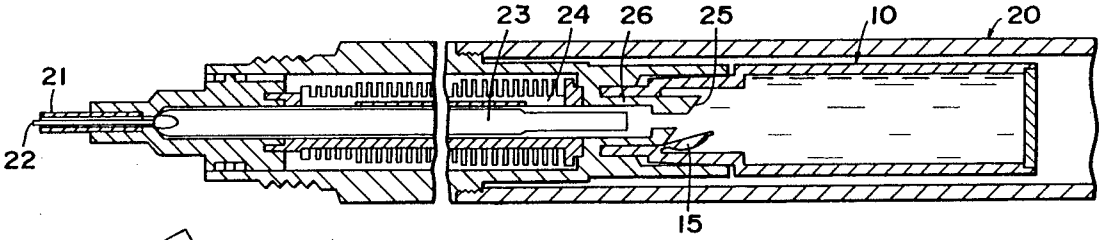
FIG. 2 is a sectional view of a part of a writing instrument with the washing liquid cartridge shown in FIG. 1 in position therein.
Figures 3A, 3B, 3C, 3D, 3E, 3F:
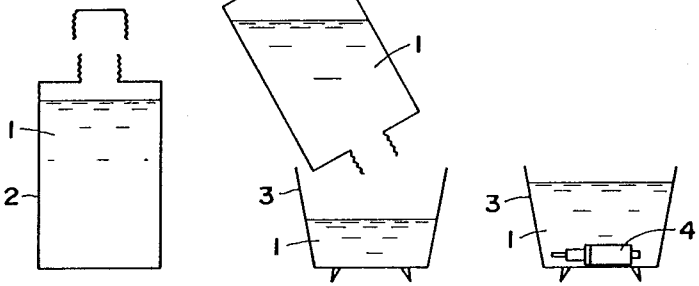
FIGS. 3A to 3F are illustrations of the steps of a conventional washing procedure using a commercially available washing liquid.

FIG. 2 shows the washing liquid cartridge 10 snugly fitted within a writing instrument which is generally illustrated at 20. The writing instrument 20 shown in FIG. 2 as an example is type having a tubular writing tip 21, a needle 22 longitudinally movably mounted within the tubular writing tip 21, a weight 23 connected to the moveable needle 22 so as to enhance the longitudinal movement of the needle 22 for ensuring a continuous and smooth capillary action of ink from a removable ink container, which is not shown but which will usually be located at the space where the washing liquid cartridge 10 is shown, toward the writing tip 21 through an ink passage 24 which is bellows-shaped in the illustrated example. This type of writing instrument is substantially similar to the writing instrument disclosed in U.S. Pat. No. 4,522,525 issued June 11, 1985 which is assigned to the assignee of the present application. The writing instrument 20 shown in FIG. 2 has a sharpened edge 25 projecting rearwardly towards the space where the washing liquid cartridge 10 or an ink container (not shown) is positioned.

In the illustrated embodiment, the washing liquid cartridge 10 has the collapsible type openable seal 15 and the sharpened edge 25 for collapsing the seal 15 is provided on a tubular element 26 of the writing instrument 20. Alternativley, a penetrator member (not shown) which has a shape similar to the sharpened edge 25 of FIG. 2 may be provided within the tubular engagement portion 14 of the washing, liquid cartridge 10 so that when the cartridge 10 is placed in position within the writing instrument 20, the penetrator member can be pushed by the end edge of the tubular element 26 against the collapsible seal 15 to break same. Thus, a device or means for penetrating the collapsble seal 15 can be provided in either the washing liquid cartridge 10 or the writing instrument 20. In either case, the opening of the seal and the fitting of the cartridge within the writing instrument can simultaneously take place.

In another embodiment, the washing liquid cartridge 10 may be provided with an openable seal of the plug type (not shown). In such a case, the cartridge is fitted within the writing instrument after the plug-type seal is opened.

The washing liquid cartridge may have any other shape and/or structure so that it is usable in a plurality of types of writing instruments.

The washing liquid usable in the present invention will be explained presently. The washing liquid must function to dissolve various kinds of resin contained in the ink and, accordingly, a suitable ingredient for the washing liquid must be selected in accordance with kinds of ink because there are number of resins which are contained in the commercially available inks. For example, an alkaline liquid of N-alkanolamines (e.g. monoethanolamine, diethanolamine, triethanolamine, etc.), an aqueous solution of sodium hydroxide, sodium carbonate and ammonia, and alcohols (e.g. methanol, ethanol, n-propanol, isopropanol, n-butanol, isobutanol, tertiary butanol, etc.) can be used alone or in combination, as washing liquid for the inks which contain alkali-soluble resins such as styrene-acrylic acid copolymer, styrene-maleic acid copolymer, polyacrylic acid, polymethacrylic acid, methyl vinyl ether-maleic anhydride copolymer, shellac, alginic acid, carboxylmethylcellulose, etc.

For the inks which contain oil-soluble resins such as rosin, alkyd resin, modified alkyd resin, phenolic resin, modified maleic resin, melamine resin, guanamine resin, ester gum, methacrylate resin, nitrocellulose and butyral, there can be used, alone or in combination, as washing liquid, organic solvents such as alcoholic solvents (e.g. methanol, ethanol, n-propanol, isopropanol, n-butanol, isobutanol, tertiary butanol, etc.), cellosolve solvents (e.g. methyl cellosolve, ethyl cellosolve, butyl cellosolve, etc.), aromatic hydrocarbon solvents (e.g. benzene, toluene, xylene, etc.) aliphatic hydrocarbon solvents (e.g. pentane, hexane, heptane, octane, cyclopentane cyclohexane, etc.), ketone solvents (e.g. acetone, methyl ethyl ketone, cyclohexanone, etc.), ester solvents (e.g. methyl formate, ethyl acetate, butyl acetate, etc.), ether solvents (e.g.

tetrahydrofuran, dioxane, etc.), γ-butyrolactone, 2-pyrrolidone, N-methyl-2-pyrrolidone and N,N-dimethylformamide. Among the various solvents described above, the alkaline liquid or soulution is preferably used in view of the fact that most of the ink commercially available contains alkali-soluble resin.

The kind of the washing liquid is selected in accordance with the materials of the parts of the writing instrument so that the parts are not damaged by the washing liquid. In general, when a resin-containing ink is prepared, a solvent for dissolving the resin is used in the ink and is selected in accordance with the material of parts of the writing instrument. Thus, if a washing liquid which contains a solvent is prepared, a solvent which is the same as the solvent used in the ink is preferably selected.

Preferably, the washing liquid has a relativley low surface tension which preferably is as low as 50 dyne/cm or less since a washing liquid having a high surface tension provides less capacity for penetration through the ink passage. A high capacity of penetration permits a faster contact with and dissolution of the solidified resin retained in the ink passage and the writing tip. Especially when an alkaline liquid or solution is employed as washing liquid, the liquid or solution generally has a relatively high surface tension and, accordingly, it is preferred to incorporate therein an anionic or nonionic surfactant, or alcohols such as methnol, ethanol, n-propanol, isopropanol, n-butanol, isobutanol, tertiary butanol, etc.

The writing instrument 20 shown in FIG. 2 was used with an ink container which contained 0.8 cc ink and was placed in a dryer to fully dry and solidify the ink. After the ink was completely dried, the ink container was removed and then the washing liquid cartridge 10 shown in FIG. 1 was inserted. Combinations of the ink and the washing liquid were as set forth in the following table.

TABLE

| Ink | Washing Liquid | Amount of Washing Liquid(cc) | Surface Tension (dyne/cm) |
|---|---|---|---|
| Aqueous ink containing styrene-acrylic acid copolymer | a mixture of water, aqueous ammonia, nonionic surfactant | 0.8 | 41 |
| Aqueous ink containing shellac | ethanol | 0.3 | 22 |
| Aqueous ink containing polyacrylate emulsion | acetone | 0.6 | 24 |
| Oil-soluble ink containing rosin | toluene | 0.7 | 28 |
| Aqueous ink containing styrene-maleic acid copolymer | a mixture of water, sodium hydroxide, methanol | 0.5 | 32 |
| Aqueous ink containing methyl vinyl ether-maleic anhydride copolymer | a mixture of water, monoethanol-amine | 1.0 | 49 |

After the writing instruments 20 with the washing liquid cartridge 10 therein were left to stand for 12 hours, it was found that, in all the combinations of the above-described table, the resin contained in the ink was fully dissolved, which was confirmed by the fact that the weight 23 was again movable, and the parts of the writing instrument were readily disassembled, and a mixed solution of the dried ink and the washing liquid retained in the bellows-like ink passage 25 was absorbed by an absorbent paper.

According to the present invention, the washing liquid cartridge can be readily positioned in a writing instrument without being extensively and unnecessarily soiled.

While preferred embodiments of the invention have been shown and described, it will be apparent to those skilled in the art that changes and modifications can be made in these embodiments without departing from the principles and spirit of the invention, the scope of which is defined in the appended claims.

What is claimed is:

1. A washing liquid cartridge mountable in a hand-held writing instrument of the type having a writing tip, an ink passage connected at its one end to said writing tip and a removable ink container releasably connected to the other end of said ink passage, said ink container containing an ink having a resin as a component thereof, said washing liquid cartridge comprising: a cartridge body having a shape for fitting into the writing instrument in place of the ink container and containing therein a washing liquid for dissolving the resin in the ink, and an engagement portion on said cartridge body for releasably connecting to the other end of the ink passage, and an openable seal adjacent to said engagement portion openable by engagement with the other end of the ink passage, whereby when said washing liquid cartridge is snugly fitted in the writing instrument in place of the ink container to connect with the ink passage at said engagement portion, said seal of said washing liquid cartridge is opened and the writing instrument can be allowed to stand and the washing liquid in said cartridge will flow into the ink passage.

2. A washing liquid cartridge according to claim 1, wherein the washing liquid contained in said washing liquid cartridge is selected from the group consisting of an alkaline liquid of N-alkanolamines, an aqueous solution of sodium hydroxide, sodium carbonate and ammonia, and alcohols.

3. A washing liquid cartridge according to claim 1, wherein the washing liquid contained in said washing liquid cartridge is an organic solvent selected from the group consisting of alcoholic solvents, cellosolve solvents, aromatic hydrocarbon solvents, aliphatic hydrocarbon solvents, ketone solvents, ester solvents, ether solvents, γ-butyrolactone, 2-pyrrolidone, N-methyl-2-pyrrolidone and N, N-dimethylformamide.

4. A washing liquid cartridge according to claim 1, wherein said cartridge is made of a transparent material.

5. A washing liquid cartridge according to claim 4, wherein said cartridge is made of a synthetic resin of polyolefin.

* * * * *